United States Patent [19]

Nikitits et al.

[11] 4,131,311

[45] * Dec. 26, 1978

[54] COMBINED FOLDING TABLE AND SEAT ASSEMBLY

[75] Inventors: Edwin Nikitits, Lachine; Jean G. Demers, Outremont, both of Canada

[73] Assignee: Franklyn M. Markus, Quebec, Canada

[ * ] Notice: The portion of the term of this patent subsequent to Nov. 30, 1993, has been disclaimed.

[21] Appl. No.: 683,327

[22] Filed: May 5, 1976

Related U.S. Application Data

[63] Continuation-in-part of Ser. No. 625,695, Oct. 24, 1975, Pat. No. 3,994,527.

[51] Int. Cl.[2] ..... A47B 39/00

[52] U.S. Cl. ..... 297/159; 297/139; 108/35

[58] Field of Search ..... 297/159, 141, 139, 157, 297/121; 108/35, 36

[56] References Cited

U.S. PATENT DOCUMENTS

| | | | |
|---|---|---|---|
| 1,272,187 | 7/1918 | Basford | 297/159 |
| 1,514,418 | 11/1924 | Battenfeld | 297/159 |
| 1,594,572 | 8/1926 | Soltesz | 297/139 |
| 1,641,010 | 8/1927 | Peterson | 297/139 X |
| 1,716,612 | 6/1929 | Wing | 297/139 X |
| 2,217,576 | 10/1940 | Weber | 297/139 X |
| 2,558,465 | 6/1951 | Seymour | 297/121 X |
| 2,647,562 | 8/1953 | Hoffar | 297/139 |
| 2,991,829 | 7/1961 | Post | 297/139 |
| 3,141,424 | 7/1964 | Seymour | 297/159 X |
| 3,256,037 | 6/1966 | Giambalvo | 297/159 |

*Primary Examiner*—Roy D. Frazier
*Assistant Examiner*—Peter A. Aschenbrenner
*Attorney, Agent, or Firm*—Hubbell, Cohen, Stiefel & Gross

[57] ABSTRACT

A collapsible combined table and seat assembly including an improved collapsible linkage for rigidly supporting the seats and for supporting the table on the seats. The linkages rely on knock down rigid triangular structures, one for supporting each seat and one extending between the seats and the table top.

34 Claims, 16 Drawing Figures

FIG. 1.
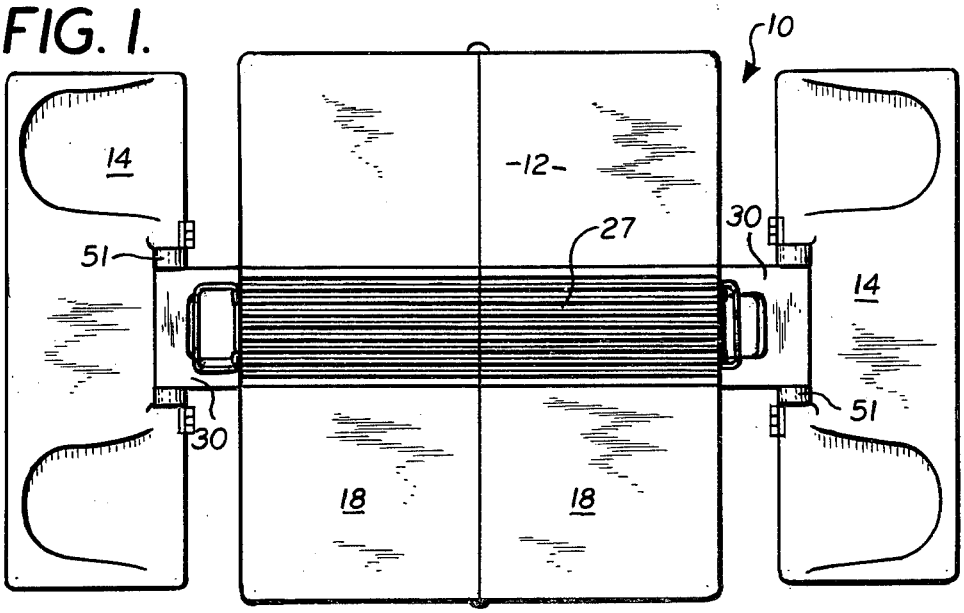
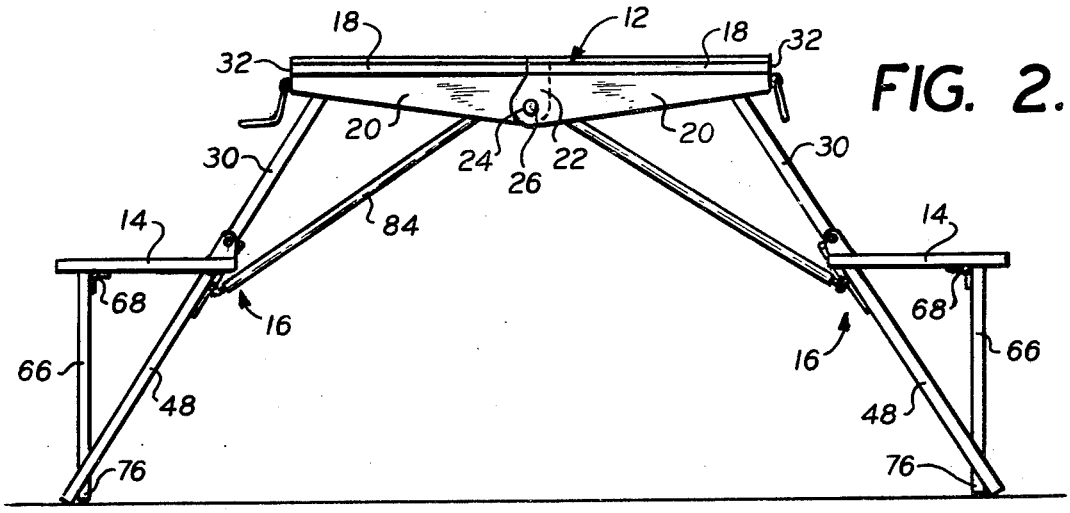
FIG. 2.
FIG. 3.
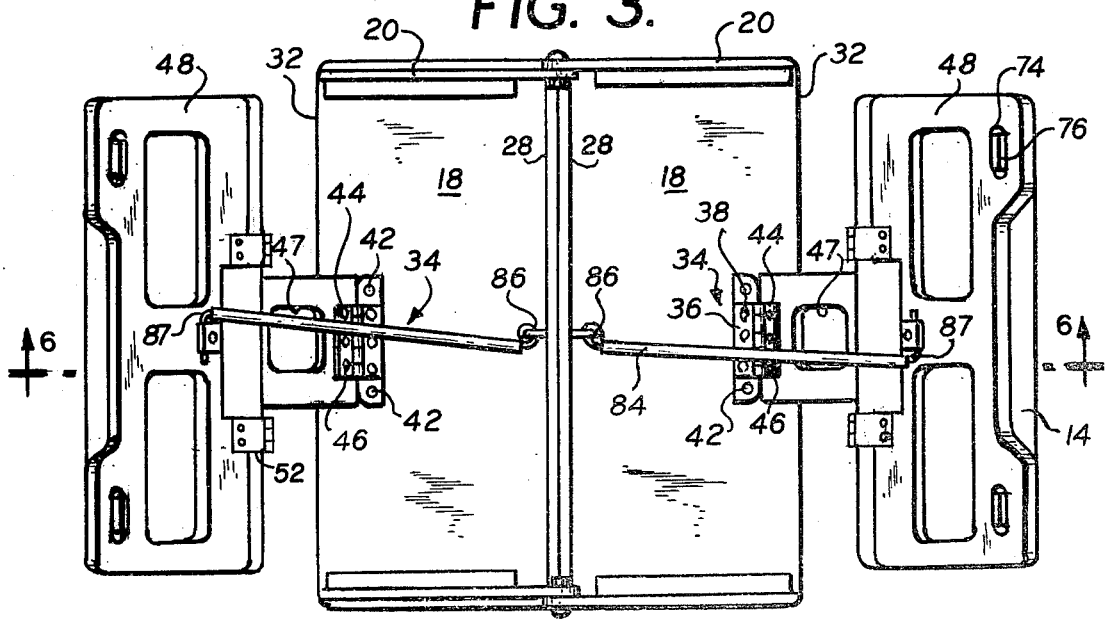

COMBINED FOLDING TABLE AND SEAT ASSEMBLY

RELATED APPLICATION

This application is a continuation-in-part of our earlier filed application Serial No. 625,695 filed by the inventors hereof on October 24, 1975, and now Patent No. 3,994,527 issued November 30, 1976, the contents of which are hereby incorporated by reference in their entirety.

BACKGROUND OF THE INVENTION

Field of the Invention

This invention relates to a combined folding table and seat assembly and particularly to a combined folding table and seat assembly that is collapsible into a self-contained carrying case comprised of the table top. Most particularly, this invention relates to a combined folding table and seat assembly which is collapsible into a case comprised of a folding table top, which assembly, when folded, is readily portable and storable in the trunk of an automobile, or a closet or the like.

The Prior Art

As the society has become increasingly mobile through the greatly expanded use of the automobile, more and more families seek to picnic along the side of a road or in a secluded spot. While, often times, prepared picnic facilities are provided, these are generally crowded and are commonly located at sites that are cultivated. Many people prefer to picnic by themselves in more natural surroundings where no dining facilities are available. Also, one often finds no permanent picnic facility at the time he wishes to eat. This generally leads to the use of a picnic blanket or the like which is uncomfortable and often untidy. Thus, there is a growing need for a portable dining facility in the form of a collapsible table and chair assembly.

A similar need has arisen in schools and other public facilities such as conference rooms which use unstructured classroom arrangements. In such arrangements, it is often desirable to clear a room entirely of tables and chairs for certain school activities. To remove standard classroom desks and chairs is an impractical solution to that problem and thus a need for a collapsible chair and desk has arisen.

The need for lightweight and durable collapsible tables and chairs has been recognized for a long time. Thus, for example, in Bassford U.S. Pat. No. 1,272,187 granted on July 9, 1918, a collapsible combined table and seats is disclosed. This Bassford assembly was, by virtue of the nature of the collapsing movements of the various components, relatively large in its collapsed condition. Moreover, there are a number of detachable elements which must be disconnected before collapse is effected and must be connected when operating it to its open position. In U.S. Pat. No. 1,514,418 granted to J. N. Battenfield on November 4, 1924, a combined folding table and seat is disclosed which includes a complex collapsible linkage that is necessarily of substantial weight if it is to have adequate rigidity. Moreover, during the assembly and disassembly of the Battenfield structure, a variety of elements must be disconnected from one another. In the Peterson Patent No. 1,641,010, a collapsible table or chair or seat arrangement is disclosed. This arrangement however has a multiplicity of detached separate parts which must be joined to assemble the assembly. This is not convenient and is time consuming. Moreover, because of the number of separate joints in the Peterson device, it is difficult to make such a device rigid without utilizing heavy costly parts. Similarly, in the patent granted to L. Wing on June 11, 1929, U.S. Patent No. 1,716,612, a collapsible combined table and seat is disclosed. However, the nature of the support of the table on the seats is such as to render the structure somewhat unstable. In Soltesz U.S. Patent No. Re. 18,207 granted September 22, 1931 still another collapsible combined table and seat is disclosed. This structure requires complex toggle linkages and numerous separate operations for assemblying and disassemblying for combined assembly. Also, the structure precludes access from the sides of the seat, thereby rendering it inconvenient in use. On October 8, 1940, a patent was granted to F. Weber, U.S. Patent No. 2,217,576, which patent is directed to a collapsible folding table and seat. This device requires complex sliding linkages which would prove to be heavy and costly. In U.S. Patent No. 2,558,465 granted to P. M. Seymour on June 26, 1951, another combined table and bench assembly is disclosed. This table and bench assembly relies heavy on chainlike tension members for stiffness which members are heavy. Also, the nature of the assembly is such that the table in the Seymour assembly will note be as stable as is required for normal dining use. Likewise, in U.S. Patent No. 2,647,562 granted to C. F. Hoffar on August 4, 1953, a combined collapsible table and seat assembly is disclosed. However, the Hoffar structure also includes complex linkages and requires a large number of independent operations for opening and closing the assembly. In addition, the Hoffar assembly includes linkages which preclude access from the sides of the benchlike seats and thereby render the assembly difficult to use. Post Patent No. 2,991,829 granted on July 11, 1961 likewise discloses a combined collapsible table and seats. This, again, includes complex toggle linkages and requires a variety of separate and distinct operations for opening and closing the assembly. Similar limitations exist in the structures illustrated and described in French Patent Nos. 1,054,743 and 1,092,230. French Patent No. 988,168 relies on a flaccid seat which is not wholly rigid in use and the support for the table top is a parallelogram which is inherently less stable than triangular supports. In U.S. Patent No. 3,141,424 which was granted to P. M. Seymour on July 21, 1964, yet another combined table and seat assembly is disclosed. This assembly does not collapse compactly and it also includes relatively difficult to make cam tracks in its linkage. Finally, in U.S. Patent No. 3,256,037 granted to J. Giambaldo on June 14, 1966, yet another form of combined table and seat is disclosed. This structure is inconveniently heavy and the linkage employed therein will not yield as rigid a structure as is required.

From the review of the prior art above presented, it will be seen that there have been numerous attempts over many years to produce a lightweight, easily unfolded and folded, combined collapsible table and seat. However, each prior art proposal has fallen somewhat short of the mark. As a result, there has been no significant commercial success for any of the prior art devices known to applicants.

BRIEF DESCRIPTION OF THE DRAWINGS

In the drawings:

FIG. 1 is a top plan view of a combined collapsible table and seats embodying the present invention;

FIG. 2 is a side elevational view thereof;

FIG. 3 is a bottom plan view thereof;

DETAILED DESCRIPTION OF PREFERRED EMBODIMENT

Figure 4:
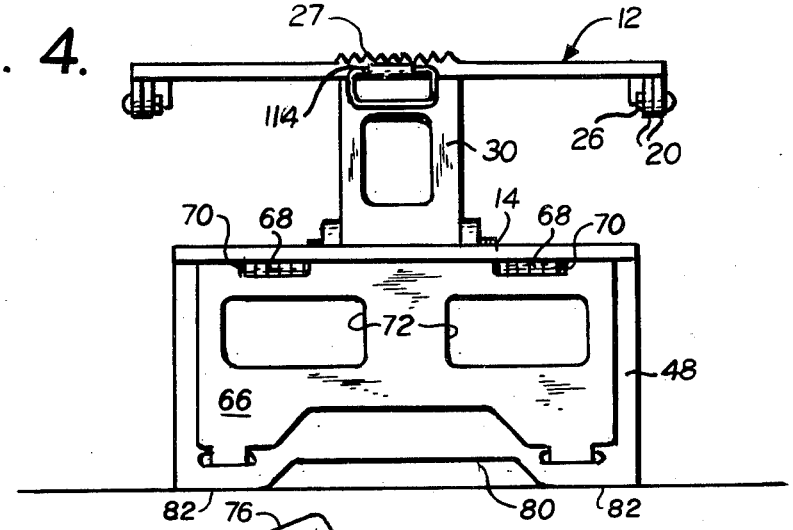
FIG. 4 is an end elevational view thereof.

Referring now to the drawings in detail and particularly to FIGS. 1 to 4 thereof, a collapsible combined table and seat assembly 10 embodying the present invention is illustrated in its unfolded or usable condition. The assembly 10 comprises a collapsible table 12 and a pair of seats in the form of benches 14 disposed on opposite ends of said table and somewhat below the table. The benches 14 are connected to the table 12 by a suitable lightweight collapsible linkage 16, which linkage in its illustrated position provides a rigid support for the benches 14 and for the table 12. As will become more apparent hereinafter, included in the linkages 16 are the benches 14 themselves and the supports therefor.

Figure 11:
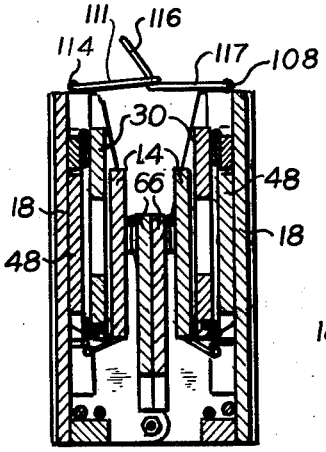
FIG. 11 is a view similar to FIGS. 6 through 10, but showing the assembly in a completely folded condition and ready for carrying or storage.
Figure 12:
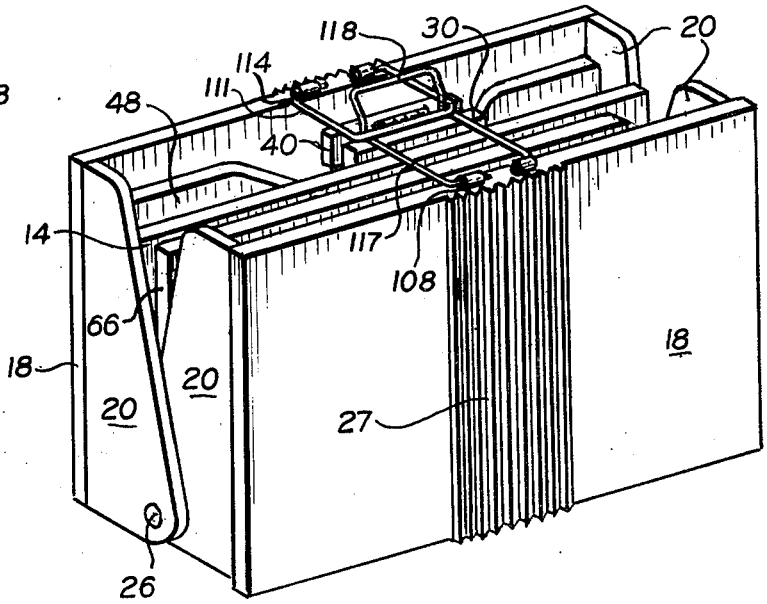
FIG. 12 is a perspective view of the assembly in the condition illustrated in FIG. 11.

The table 12 is comprised of two relatively pivotally movable table top portions 18 which may be made of any suitable material such as, for example, wood, sheet metal such as sheet aluminum, fiberboard, and, as presently preferred, fiber glass reinforced plastic. Preferably, the material is lightweight and to this end composite structures such as honeycomb cores may be employed. Among materials which may be useful for forming the table 12 are materials formed by foam injection molding. Such materials may be polystyrene, polycarbonate, polyvinylchloride, low molecular weight polyethylene, polypropylene, or other similar materials capable of being employed for structural foam injection molding. Such materials and the process of foam injection molding are described in the following U.S. patents, the contents of which are hereby incorporated by reference in their entireties: 3,058,161; 3,211,605; 3,628,636; 3,384,691; 3,436,446; 3,599,290; 3,674,401, and 3,746,492. Extending along the opposite edges of each of the table portions 18 are vertically extending reinforcing struts 20 which overlap at the center of the table 12 and are provided in the zone of overlap designated by the reference numeral 22 with registered apertures 24 through which extend suitable pivots in any suitable form such as, for example, screws 26 or rivets. Thus, when the assembly 10 is conditioned for collapse, the two table top portions 18 can be pivoted relative to one another from the open position illustrated in FIGS. 1 to 4 in which they are in co-planar end-to-end relation and to a closed position in which they are in parallel spaced apart confronting relation as illustrated in FIGS. 11 and 12. As viewed in FIG. 2, the movement of the lefthand table top portion 18 to collapse the table 12 would be counterclockwise and the movement of the righthand table top portion 18 would be clockwise. This would bring the two table top portions into their closed position in which they are in spaced apart confronting relation, as will be described in greater detail hereinafter. The struts 20 may be formed separately from the table top portions 18 and joined thereto in any suitable manner such as by the use of adhesives or by the use of securing elements such as screws or the like. In lieu thereof, each table top portion may be formed from a fiber glass reinforced plastic material or from sheet aluminum, in which event the struts 20 may readily be formed integrally with the table top portion 18. To further stiffen the table top, it may be provided with a plurality of reinforcing ribs 27 if desired. As shown and preferred, extending along the confronting edges of the two table top portions 18 are a pair of confronting depending cross braces 28. The braces 28 may be formed separately from the table top portions 18 and then secured thereto in any suitable manner or they may be formed integrally with such table top portions as in the formation thereof from fiber glass reinforced plastic. Such integral construction could also be employed by fabricating the table top portions and associated bracing from metal stampings or the like. As shown, the cross braces, in addition to stiffening the table top 12, also serve as stops to limit the relative pivotal movement of the two table portions 18 so that they will be in co-planar relation when opened, although this is not necessary to practicing this invention.

Figure 5:
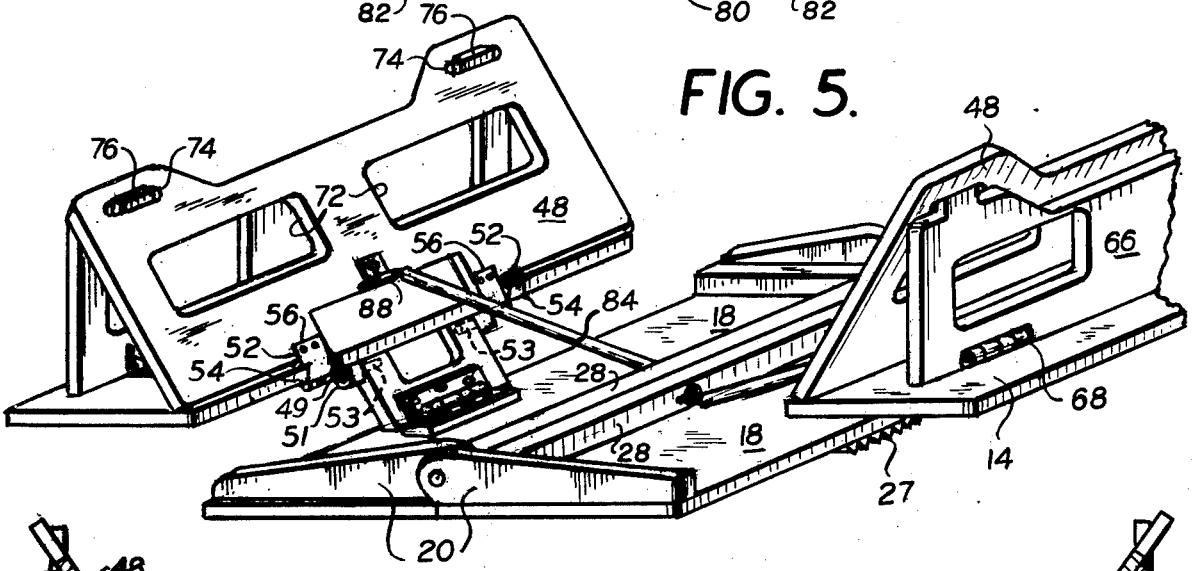
FIG. 5 is a perspective view of the assembly of FIG. 1 shown upside down, but in a fully unfolded condition and ready for use upon being turned right side up.

The linkages 16 each include a downwardly angularly extending central support member 30, which support members are pivotally mounted on the outer ends 32 of the table top portions 18 as by hinges 34. As best seen in FIG. 3, the hinges 34 each have one strap 36 secured to the bottom of the associated table top portion 18 adjacent the edge 32 by any suitable means such as, for example, screws 38. Clearly, other means for securing the strap 36 to the bottom of the table top portions 18 could be employed. It is desirable to underlie straps 36 with shims 40 which are illustrated in the form of elongated rectangular bars, which shims themselves may be secured to the table top portions by screws 42 or the like, as shown. The main function of the shims 40 is to provide a suitable spacing of the supports 30 from the table top portions to enable the collapsed linkages 16 to be received within the enclosed and collapsed assembly as will be described hereinafter. The shims also strengthen the connection between supports 30 and their associated table portions 18. The second hinge strap 44 of each of the hinges 34 is secured to its associated centrally disposed support 30 in any suitable fashion such as, for instance, by screws 46. As may best be seen in FIG. 5, each of the table supports 30 is in the form of a rectangular platelike member that is made of a stiff material such as wood, metal, fiberboard or fiber glass reinforced plastic. Preferably, the material is relatively lightweight and, if desired, further lightening may be effected by providing each support 30 with a cut-out 47. It is the supports 30, which extend upwardly from the forward ends of the seats 14, that serve as the main loadbearing members for supporting the table top 12. Hinges 34 permit relative pivotal movement between the supports 30 and table top portions 18 between an open position shown in FIG. 2 and a closed position in which the support is substantially parallel to and in spaced confronting relation with its associated table top portion 18. Preferably, a stop is provided to prevent movement of the supports beyond their open position. As may be seen in FIG. 6, this stop is effected by the engagement of the upper end of support 30 with the bottom surface of table top portion 18. Of course, other types of stops may be employed.

The lower ends of the members 30 are pivotally connected to the forward edges of seats 14, as pivot pins 49 which extend through seats 14 and into a registered cavity 53 in members 30.

Figure 8:
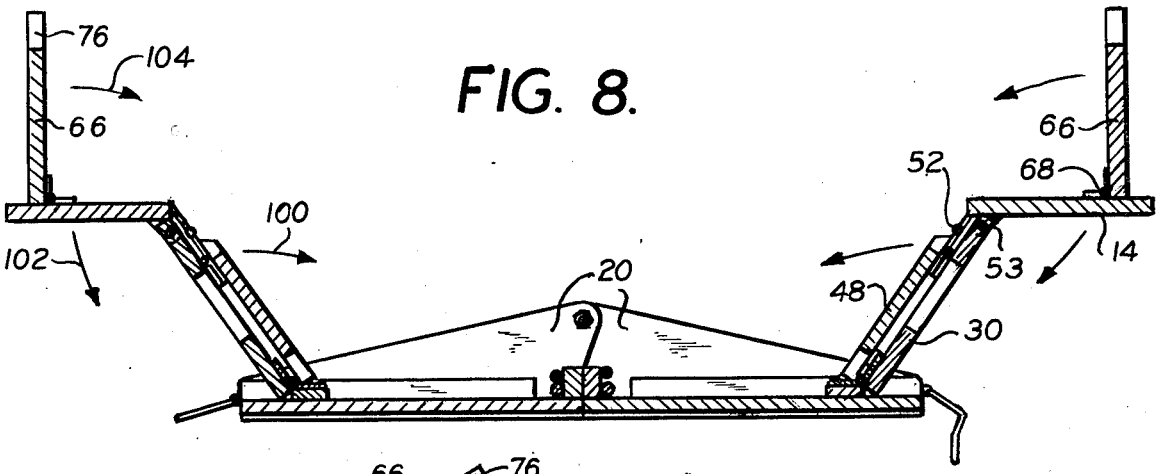
FIG. 8 is a view similar to FIGS. 6 and 7, but showing the assembly in still a further collapsed or folded condition.

Pivotally mounted on the bottom of the front edges of seats 14 are main legs 48. Each of the legs 48 is preferably, although not necessary, a stiff platelike member made of any suitable material such as wood, metal, fiberboard, fiber glass reinforced plastic or the like. Preferably, the material from which the member 48 is made, and all of the materials employed herein, is lightweight and of great rigidity. To further lighten the weight of the legs 48, which extend substantially the full width of the seats 14, the legs may be and are shown to be provided with weight saving cut-outs 50. The main legs 48 are connected to the seats 14 by a suitable pivotal connection such as, for example, hinges 52 having upper straps 54 connected to the front edges of the seat 14 and lower straps 56 connected to the inner surfaces of the main legs 48. Any suitable mode of connecting the hinge straps 54 and 56 to the seats 14 and legs 48 may be employed, such as, for example, screws, rivets, adhesives, soldering or welding or the like as may be appropriate. Clearly, the choice of such connection means for this connection and for all other similar connections throughout the structure will be dependent in a large degree on the nature of the materials being employed. Hinges 52 permit movement between seats 14 and main legs 48 to an open position shown in FIG. 2 in which they are at a substantial acute angle to one another and said main legs 48 are in substantial coplanarity with said supports 30, and a closed position in which said main legs and seats are in parallel relation with members 30 interposed therebetween (FIG. 8). A stop is included to prevent movement of the members beyond their open position which stop is preferably part of the structure of hinges 52 themselves.

To support the seat 14 in the horizontal position shown in FIG. 2 when the assembly 10 is in its unfolded condition and ready for use, yet another platelike leg member 66 is included in each of the linkages 16. The leg members 66 are pivotally connected to the outer edges of the seats 14 by any suitable means such as, for example, hinges 68 having one strap connected to the bottom surface of the seat 14 adjacent the outer edge thereof and the other strap connected to the inner surface of the legs 66 at the upper end thereof. Preferably, and as shown, the pivotal connection between seats 14 and legs 66 is distributed along the length of the joint as for example by the use of two widely spaced hinges 68 for each such pivotal joint. The manner of connection of hinges is illustrated to be by means of screws, although any other suitable connecting mechanism may be employed. Hinges 68 permit movement between said other legs 66 and the seats 14 between an open position in which legs 66 extend downwardly at an angle, preferably a right angle, to seats 14 (FIG. 2) and a closed position in which seats 14 and legs 66 are in close confronting substantially parallel relation. While the leg members 66 are preferably (although not necessarily) rectangular platelike members made of any suitable lightweight rigid material such as wood, metal, fiberboard, fiber glass reinforced plastic or the like, it is not wholly rectangular as may be seen best in FIG. 4. For example, along the upper edge of each of the leg members 66 there are a pair of cut-outs 70 to accommodate the hinges 68 which pivotally mount the leg members 66 to the seats 14. In addition, the leg members 66 may be provided, as shown, with weight saving cut-outs 72. To rigidify the support for the seats 14, means are provided for detachably connecting the leg members 66 to the leg members 48 in order to provide a stable triangular support for each of the seats, said triangular support including, of course, the seats 14 themselves. The means for effecting this detachable connection between the legs 66 and the legs 48 include one or more slits 74 in each of the leg members 48, here shown as two in number. Associated with each of the slits 74 is a downwardly extending or depending tab 76 on the bottom edge of each of the leg members 66, which tabs are registrable with the slits 74 in the associated legs 48 and are receivable therein. When the tabs 76 are disposed within their associated slits 74, the lower edge 78 of the leg supports 66 will bear against the legs 48 to form a rigid triangular support for each seat 14. To further save weight in the assembly 10 and to provide for a more stable support for each seat 14, preferably, the lowermost central portions of the leg members 48 are removed to form an elongated recess 80 along the bottom edge, whereby to cause only two relatively short portions 82 of the bottom of the leg support 48 to bear against the ground, floor or other supporting surface.

With the two seats 14 provided with rigid ground supports as described, and with the central table support 30 extending upwardly at angles to hold up the table 12, a satisfactory collapsible table assembly is provided. However, additional bracing or stiffening members are provided in the linkage 16 to support both halves 18 of the table 12 with the same type of triangular rigid support structure as is employed for the seats 14. As shown, the additional members in the linkage 16 are two bracing rods 84 which extend between the bottoms of the table top portions 18 and to either members 30 or main legs 48, here shown and preferred to be main legs 48. As may best be seen in FIG. 3, the bracing members 84 are rodlike in form and are pivotally mounted as for example, by a pair of interengaging eyes 86 connected to rods 84 and adjacent the transverse struts 28 for omnidirectional pivotal movement. The outer ends of each of the rods 84 are hooked at right angles to the longitudinal axis of the rods, the hooked end portions being designated by the reference numerals 87. Disposed adjacent the upper edge of the main leg 48 is a tubular member 88 which is preferably of substantial longitudinal extent, say, for example, at least a half an inch. However, an ordinary eye could be employed without departing from the invention. The passage in each of the tubes 88 is proportioned to receive the right angle hooked ends 87 of the rods 84, whereby to fix the hooked ends 87 to the main leg 48. When the rods are so hooked, then the table top portions 18 form a rigid triangular structure to insure that each table top portion 18 will be rigidly held aginst pivoting or any other substantial movement in use. As already noted, if desired, tubes 88 could be connected to members 30, preferably between the bottom edge and cutout 47.

Rather than using the rods 84 with their detachable hooked ends 86, a togglelike brace could be substituted with one end of the toggle being permanently pivotally secured to the bottom of each of the table top portions 18 and the other end of the toggle being permanently pivotally secured in the location now set aside for the tubular members 88, that is near the top of legs 48 or near the bottom of member 30. In such an instance, the toggle would, of course, collapse when appropriately broken in a way that is well known to the skilled art worker.

If desired, each of the seats 14 may be provided with a pair of backs in the form of substantially square plate-like members made of any suitable lightweight rigid material as heretofore mentioned by way of example, which backs would each be pivotally mounted on the seats 14 as by hinges for pivotal movement between an open or upstanding position in which they serve as back rests and a closed or folded position in which they are in close confronting relation with seat 14. Stops may be included to prevent the back rests from going beyond the defined open position which stops could be effected by the engagement of the lower ends of the back rests with the seats. The vertical extent of the backs should preferably not exceed the horizontal extent of the seat 14. Such a structure is described in detail in the parent application Serial No. 625,695 and reference to such application may be had for a more detailed description of this optional feature.

From the foregoing description, it will be seen that the collapsible chair and table assembly 10 when fully unfolded or open and with the linkages 16 in their connected rigid condition will provide an extremely rigid support structure for both the seats 14 and the table 12. Moreover, the table 12 will be rigidly located between the supporting seats 14. In addition, in the embodiment shown in FIG. 1, it is to be noted that the only portion of the linkage 16 extending between the table top 12 and the seat 14, that is supports 30, is preferably located in the center of both the table top and the seat whereby to permit the users of the device to slide in from the sides, thereby obviating the necessity of crawling over the seats to be seated at the table. Thus, in assembled condition, the assembly 10 is extremely convenient to use.

As noted throughout this specification, the assembly 10 is collapsible. All of the structure for effectuating the collapse has been described but the mode of use of the assembly to collapse it and to unfold it will now be described. While the sequence of steps hereinafter described for folding up the assembly 10 is the presently preferred sequence, it will be obvious to anyone skilled in the art that a variety of sequences for collapsing the assembly is available and the use of any of them is deemed to be within the contemplation of this invention. Thus, the following description is exemplary of the preferred form of collapsing the assembly, but is clearly not the only manner in which this may be achieved.

Figure 6:
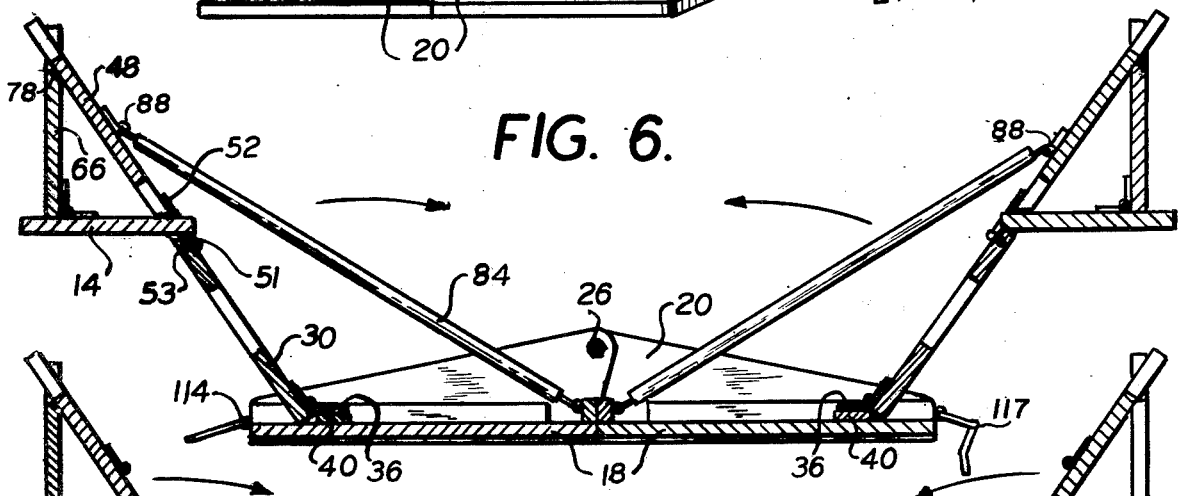
FIG. 6 is a sectional view taken along the line 6—6 in FIG. 3.
Figure 7:
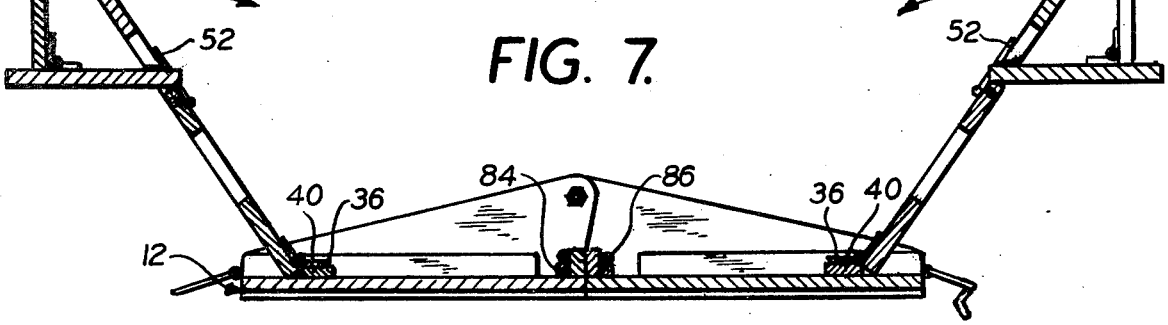
FIG. 7 is a view similar to FIG. 6, but showing the bracing links folded away.

Preferably, although not necessarily, the first step in collapsing the assembly 10 is to turn it upside down so that the table top rests on the ground, floor or other supporting surface. This position is shown in FIG. 6 wherein the assembly 10 is still in assembled or open condition. The next step in collapsing assembly 10 is to unhook the hooked ends 87 of the bracing rods 84 from the tubular members 88 and swing rods 84 into a position parallel to the edge braces and stops 28 as may be seen in FIG. 7.

Figure 9:
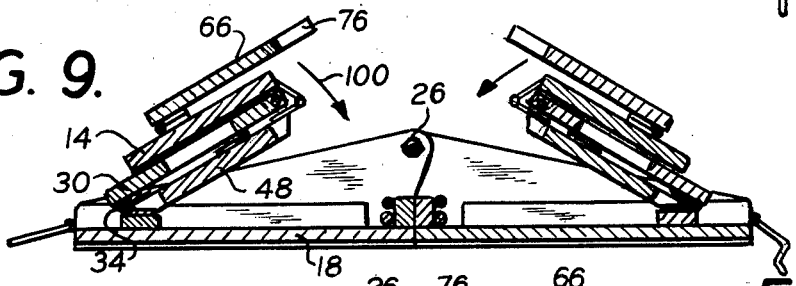
FIG. 9 is a view similar to FIGS. 6 through 8, but showing the seat portions of the assembly completely folded.

As may best be seen by reference to the left side of FIG. 8, the main leg supports 48 are then swung about their hinges 52 to bring those leg supports into their closed position in confronting relation with the members 30. This is effected by first detaching the tabs 76 on the ends of the leg members 66 from the slits 74 in the main leg supports 48. The supports 30, together with their associated close confronting leg supports 48, are then swung in the direction of the arrows 100 in FIGS. 8 and 9 to the intermediate position shown in FIG. 9 in which position the seats 14 may be swung in the dirction of the arrows 102 to bring the seats into their closed position in confronting relation with the opposite surfaces of the supports 30 from the main legs 48. Then the other legs 66 may be pivoted about the hinges 68 in the direction of the arrows 104 to bring the seat assembly to the condition of FIG. 9, wherein all of the main linkgs save for the rods 84 are in their closed positions in close confronting substantially parallel relationship. In that position, the entire collapsed seat assemblies may be pivoted about the pivots 34 from the positions shown in FIG. 9 to the closed positions shown in FIG. 10 wherein each of the seat subassemblies lies substantially parallel to its underlying and associated table portion 18. A perusal of FIG. 10 will demonstrate the desirability for inclusion of the shims 40 underlying the hinges 34 in order to provide for a co-planar confronting relationship between the leg members 48 and the undersurface of the associated table portion 18.

Figure 10:
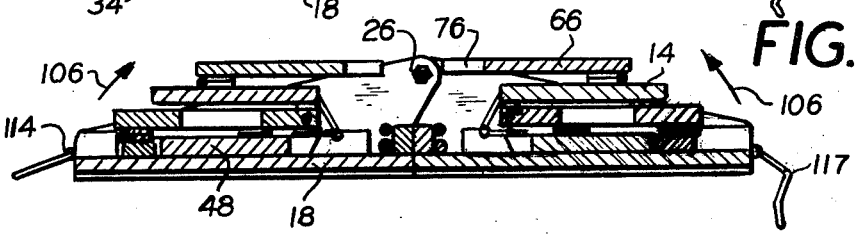
FIG. 10 is a view similar to FIGS. 6 and 9, but showing the folded seat portions folded against their associated foldable table halves.

Once the assembly 10 has been collapsed to the condition shown in FIG. 10, all that need be done is to pivot the two halves of the table top 12, that is the two table top portions 18, about their central pivot 26 in the direction of the arrows 106, whereby to move the two table top portions 18 into their closed position in spaced apart parallel relation encasing or enveloping the seats 14 and the support linkages 16 hereinbefore described. This folded condition is shown in FIG. 11.

To facilitate the holding of the assembly 10 in the position illustrated in FIG. 11, a suitable latch is provided as well as a handle for carrying the assembly 10. As best seen in FIGS. 11 and 12, the latch and handle are preferably combined in one structure, although, clearly, the two functions could be performed by two separate structures. Specifically, as shown in FIGS. 11 and 12, pivotally connected to one of the table top portions 18 at the outer edge thereof as at 114 is a U-shaped wire member 111 which is proportioned to receive within it a second U-shaped wire member 117 that is bent at its center into an L shape. The other end of the member 117 is pivotally mounted on the outer edge of the opposite table top portion 18 as at 108. With the upstanding portion 116 of the bent U-shaped member 117 extending upwardly between the legs of the U-shaped member 111, the entire collapsed assembly can be carried by using the bight 118 of the folded U-shaped member 117 as a handle. In the closed condition shown in FIGS. 11 and 12, the entire assembly 10 is sufficiently compact to fit easily within the trunk of an automobile for transport. Additionally, the structure is readily storable in the closet of a schoolroom or the like if such use is made of the assembly 10.

To reopen the assembly 10, a reverse series of the steps above-described may be employed.

Figure 13:
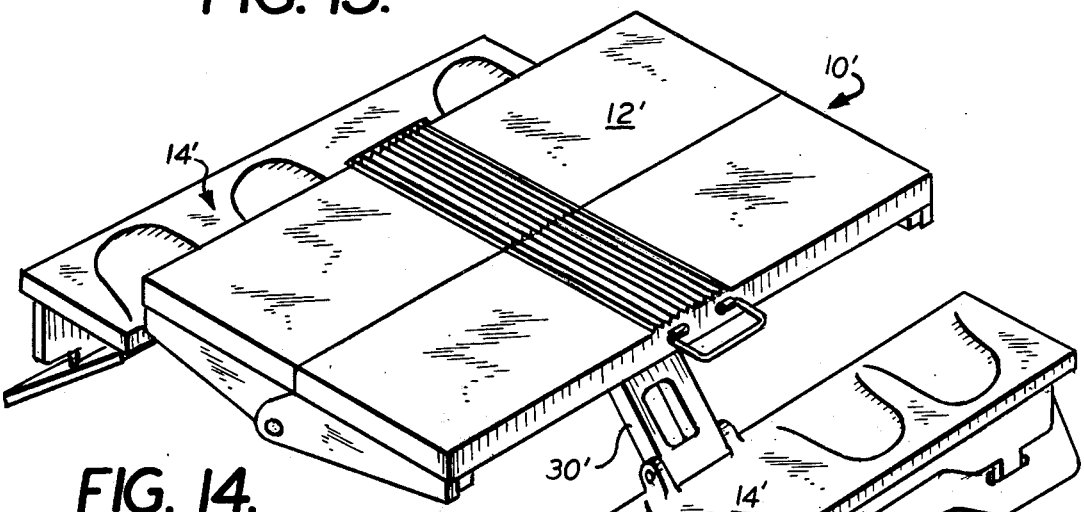
FIG. 13 is a perspective view of a modified form of combined table and seat assembly embodying the present invention.

Referring now to FIG. 13, a modified form of collapsible combined table and seat assembly 10' is shown. The assembly 10' illustrated in FIG. 13 is in all respects identical with the assembly 10 in FIGS. 1 through 12 hereinbefore described, save as noted hereinafter. Specifically, the assembly 10' illustrates that the invention does not contemplate limitation to a table with seats for only four persons. Thus, in the FIG. 13 embodiment, the assembly 10' is proportioned so that the seats 14' may accommodate three persons each, whereby to seat a total of six persons about the table 12'. If back rests are employed, three separate back rests (not shown) may be provided on each side of the table. Alternatively, however, if back rests are to be employed, there may be only two back rests on each side, one being suitable for use by one person and the other being suitable for use by two persons. The main support members 30 are pivoted on the seats 14' at a location between seat locations so as to minimize interference with the users seating themselves without having to climb over the benches 14'.

Figure 14:
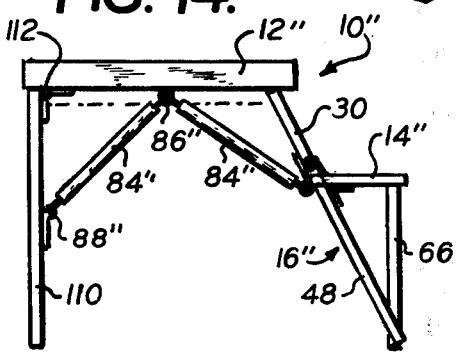
FIG. 14 is a side elevational view of yet another modified form of the present invention.

Referring now to FIG. 14, still another form of the invention is illustrated. This form of the invention, while useful for outdoor picnicing and the like, is particularly suitable for household use and for school use. In the structure of FIG. 14, the assembly is designated by the reference numeral 10'', which assembly includes a seat 14'' only at one end of the table 12''. Seat 14'' may be proportioned for one, two, or more persons and if it can accommodate at least two, the support 30 are preferably connected to seat 14'' in between two seat locations as in assemblies 10 and 10' above described. The manner of supporting the seat 14'' that is the linkage 16'', is in all respects identical with the linkages 16 in the FIG. 1 embodiment. To support the opposite end of the table 12'', a collapsible rigid leg 110 is provided, which leg is pivotally connected to the bottom of the table 12'' by a hinge or preferably several spaced apart hinges 112. A detachable brace 84'' extends from about the center of the bottom of the table 12'' to some intermediate point on the leg 110 where it is detachably connected as by a tubular member 88'' in the same manner as hereinbefore described for the corresponding parts in assembly 10. When it is desired to collapse the assembly 10'', the seat 14'' and its associates linkage 16'' are collapsed in the exact same manner as the same parts are collapsed in the FIG. 1 embodiment. With respect to the rigid support leg 110, all that need be done is to detach the link 84'' from the tube 88'' on the leg 110 and swing the link out of the way, whereby to permit the pivoting of the leg 110 from the solid line position in FIG. 14 to the dotted line position in said figure. Desirably, the leg 110 is a rigid platelike member provided with central cut-outs to reduce the weight and to prevent interference between the folded leg 110, the folded links 84'' and their table mountings 86''. Clearly, the assembly 10'' would have many important household uses, especially for children, as well as important uses in schools, auditoriums, convention centers and the like. Of course, it also has outdoor uses as well.

Figure 16:
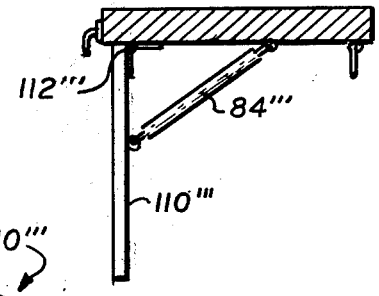
FIG. 16 is a sectional view taken along the line 16—16 of FIG. 15.
Figure 15:
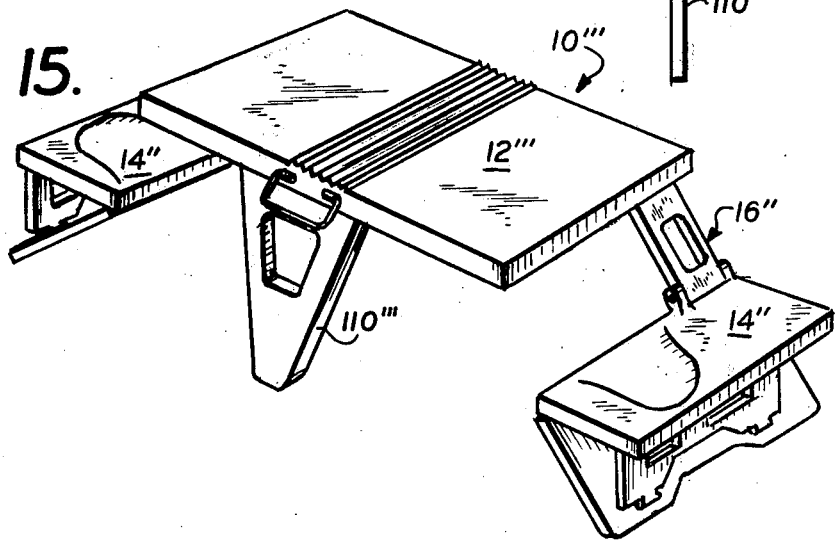
FIG. 15 is a perspective view of still another embodiment of the present invention.

Referring now to FIGS. 15 and 16, still another modification of the invention is illustrated wherein the collapsible table and seat assembly is designated by the reference character 10'''. The assembly 10''' is in all respects identical with the assembly 10 of FIG. 1, save for the following differences. First, it will be seen that the table 12''' is not foldable, but is a unitary rigid piece. However, if desired, it may be collapsible in the same manner as the FIG. 1 embodiment. The second difference is that the seats 14''' are proportioned for use by one person only and this results in the support members 30''' being provided at one side of side seats rather than at some point intermediate the two seat ends. However, the user can slide in from the opposite side from the supports 30'''.

Since the table top 12''' is supported only adjacent one side thereof, it is desirable that a suitable support be provided at the other side. As shown herein, that support is a leg 110''' which is generally similar to the leg 110 in the FIG. 14 embodiment, although preferably of lesser width than the leg 110. Apart from that difference, it will be seen that it is mounted in the same way, that is, by a hinge 112''' and is braced by a suitable brace 84''' in the same manner as the brace 84'' braces the leg 110 of the FIG. 14 embodiment. The manner of knocking down and opening up the assembly 10''' will be obvious to anyone skilled in the art who has read the foregoing specification.

It will be recognized that collapsible combined seats and tables of the type hereinbefore described need not be symmetrical about a center fold line as in the table top 12 and need not be inherently stable by virtue of their own structure exclusively That is to say, it is within the contemplation of this invention to wall mount the table top by a suitable pivotal mounting so that the table top will be supported at one end by the wall on which it is mounted and on the other end by an associated seat 14 ad its linkage 16. For example, with reference to the table of FIGS. 1 to 3, if the table were split so that there were only one seat and one table top half 18, the edge of the table top half 18 remote from the seat 14 could be pivotally mounted on a wall so that the wall would serve as the support for that edge of the table top half 18, and the seat 14 and its linkage 16 would serve as the other support. The entire assembly could be folded together in the manner previously described and then swung against the wall in a vertical orientation. Similar provisions can be made with other embodiments of this invention.

In addition, while the invention is primarily contemplated for use by people it should be understood that similar structures which are of very small scale can be employed by children playing with dolls, and that such miniature sized collapsible seats and tables would come within the scope of the present invention. Such a full sized embodiment has the advantage of compact storability as would a miniature size used for seats for dolls or the like. Obviously, intermediate scaled assemblies may be constructed for use with infants and children.

Thus, it will be seen that the present invention has a wide variety of embodiments which are eminently suitable to a number of different applications. Thus, for example, the FIG. 1 and FIG. 13 embodiments are especially suited for outdoor use, although they have application indoors in schools, auditoriums and the like. The FIG. 14 embodiment is particularly useful for school classrooms and for home use, especially for children, as is the FIG. 15 embodiment hereinbefore described. However, each of these embodiments, although they may have an indicated special use, may be used outdoors or in any other fashion deemed suitable by the user without departing from the invention.

While we have herein shown and described the preferred forms of this invention and have suggested a variety of modifications therein, other changes and modifications may be made therein within the scope of the appended claims without departing from the spirit and scope of this invention.

What is claimed is:

1. In a collapsible combined table and confronting seat of the type wherein said seat and table are relatively pivotally movable between an open position wherein said table and seat are horizontal and the front edge of said seat is disposed adjacent and below one end of said table and a folded position wherein said seat is in substantially parallel relation with said table, an improved collapsible linkage for supporting said table and seat in said open position and for permitting said pivotal movement to said folded position, said linkage comprising:

a support member pivotally mounted at one end thereof to said table adjacent said one end of said table for movement between an open position in which said support member extends downwardly from said table and a closed position in which said support member is in confronting parallel relation with the bottom surface of said table;

a main leg, means for operatively pivotally mounting said main leg on said support member for movement relative to said support member between an open position in which said main leg and said support member are in substantially co-planar end-to-end relation and a closed position in which said main leg and support member are in confronting substantially parallel relation, whereby when said support member and said table are in their open position and said support member and said main leg are in their open position, said main leg extends downwardly away from said table, and when said table, said support member and said main leg are in their respective closed positions, said main leg and said support member are in confronting parallel relation with the bottom of said table;

means for pivotally mounting said seat on said support member for relative pivotal movement between an open position in which said seat extends outwardly away from said support member and substantially parallel to said table and a closed position in which said seat is in parallel relation with said support member;

another leg member, said other leg member being pivotally mounted along one edge thereof on said seat adjacent the edge of said seat remote from said table for movement between an open position in which said other leg member extends downwardly from said seat toward the bottom of said main leg when said main leg is in its open position relative to said support member and a closed position in which said other leg is in substantially parallel relation with said seat; and means for detachably connecting said other leg to said main leg when all the elements of said linkage are in their respective open positions.

2. The collapsible combined table and seat as defined in claim 1, further comprising a collapsible brace operable to a bracing position wherein, wherein said brace rigidly extends between a pivot on the bottom of said table remote from said one end of said table and a point either on said support member or on said main leg when said support member and main leg are in their respective open positions, whereby to prevent pivotal movement between said table, said support and said main leg, said support being operable to a nonbracing position to permit pivotal movement between said table, said support and said main leg.

3. The collapsible combined table and seat as defined in claim 2, wherein said collapsible brace is a rigid rod detachably connected at one end.

4. The collapsible combined table and seat as defined in claim 3, wherein said rod is pivotally connected at its other end.

5. The collapsible combined table and seat as defined in claim 4, wherein said rod is pivotally connected on said table and detachably connectable to either said support or said main leg.

6. The collapsible combined table and seat as defined in claim 1, wherein said means for operatively pivotally mounting said main leg on said support member comprises means for pivotally mounting said main leg to said seat adjacent the edge thereof confronting said table, and said main leg when in said closed position is in close confronting relation with said support, and when said table, said main leg and said support member are in their respective closed positions, they are in parallel confronting relation with said main leg disposed between said table and said support member.

7. The collapsible combined table and seat as defined in claim 1, further comprising collapsible means for supporting the other end of said table.

8. The collapsible combined table and seat as defined in claim 1, wherein said table comprises two like table portions, and means for pivotally connecting said two table portions for movement between an open position in which said two table portions are in end-to-end coplanar relation and a closed position in which said two table portions are in substantially parallel spaced apart confronting relation, and wherein there is a seat for each end of said table, and wherein there is an improved collapsible linkage connecting each one of said seats to the adjacent one of said table portions 9. The collapsible combined table and seat as defined in claim 8, further comprising stop means for preventing relative pivotal movement of said two table portions from said closed position to a position beyond said open position.

10. The collapsible combined table and seat as defined in claim 9, wherein said stop means comprise a pair of transverse members depending from said table portions along the ends thereof which are in end-to-end relation when said table is in its open position.

11. The collapsible combined table and seat as defined in claim 10, wherein said transverse members extend along substantially the full extents of said table ends.

12. The collapsible combined table and seat as defined in claim 8, further comprising a collapsible brace for each linkage, each brace being operable to a bracing position wherein said brace rigidly extends between a point on the bottom of said table portions associated therewith at a point adjacent the end thereof which is in end-to-end relation with said other table portion and a point on a member of the associated linkage taken from the class consisting of said support member and said main leg when said support member, said main leg and said table are in their respective open conditions.

13. The collapsible combined table and seat as defined in claim 12, wherein said collapsible braces are rigid rods pivotally connected to said table members and detachably connected to said support members.

14. The collapsible combined table and seat as defined in claim 1, wherein said seat is an elongated bench having seating locations for at least two persons, and said support member is pivotally connected to said bench between two of said seating locations.

15. The collapsible combined table and seat as defined in claim 13, wherein said seats are elongated benches each having seating locations for at least two persons, and said support members are pivotally connected to their associated bench between two of said seating locations.

16. The collapsible combined table and seat as defined in claim 6, wherein said means for pivotally mounting said seat on said support member is located adjacent the other end of said support member and adjacent the edge of said seat confronting said table.

17. The collapsible combined table and seat as defined in claim 16, wherein when said other leg is in its closed position, it is in close confronting parallel relation with the bottom of said seat.

18. The collapsible combined table and seat as defined in claim 17, further comprising a collapsible brace operable to a bracing position, wherein said brace rigidly extends between a pivot on the bottom of said table remote from said one end of said table and a point either on said support member or on said main leg when said support member and main leg are in their respective open positions, whereby to prevent pivotal movement between said table, said support and said main leg, said support being operable to a nonbracing position to permit pivotal movement between said table, said support and said main leg.

19. The collapsible combined table and seat as defined in claim 13, wherein said main leg and said other leg in each linkage are platelike members of length substantially equal to the length of their associated seats, and wherein said means for connecting each of said main legs to its associated other leg comprises a tab extending outwardly in the plane of said other leg from the edge of said other leg which is opposite to said one edge of said other leg, said main leg having a slit therein adjacent the end thereof which is remote from said support member when said main leg and support member are in their open positions, said slit being proportioned to receive said tab therein.

20. The collapsible combined table and seat as defined in claim 7, wherein said collapsible means for supporting said other end of said table is a rigid leg pivotally mounted on said table adjacent said other end for movement to an open position in which said rigid leg depends from said table and to a closed position in which said rigid leg is in parallel confronting relation with said table.

21. The collapsible combined table and seat as defined in claim 20, and further comprising a collapsible brace operable to a bracing position in which it rigidly extends between the bottom of said table and a point on said leg intermediate its two ends at an angle to both for preventing relative pivotal movement between said rigid leg and said table, and a non-bracing position to permit relative pivotal movement between said table and said rigid leg.

22. The collapsible combined table and seat as defined in claim 21, wherein said collapsible brace is a rigid rod detachably connected at one end.

23. The collapsible combined table and seat as defined in claim 22, wherein said rod is pivotally connected at the other end.

24. The collapsible combined table and seat as defined in claim 7, wherein said collapsible means for supporting the other end of said table comprises a second seat at said other end of said table, and a second of said linkages for supporting said second seat and the other end of said table.

25. The collapsible combined table and seat as defined in claim 24, wherein the support members in each of said linkages are connected to said table and their associated seats along one side thereof, a rigid leg for supporting the other side of said table, and means for positioning said leg in an open position in which it depends from said table and in a closed position in which it is in substantially parallel confronting relation with said table.

26. The collapsible combined table and seat as defined in claim 25, and further comprising a collapsible brace operable to a bracing position in which it rigidly extends between the bottom of said table and a point on said leg intermediate its two ends at an angle to both for preventing relative pivotal movement between said rigid leg and said table, and a non-bracing position to permit relative pivotal movement between said table and said rigid leg.

27. The collapsible combined table and seat as defined in claim 26, wherein said collapsible brace is a rigid rod detachably connected at one end.

28. The collapsible combined table and seat as defined in claim 27, wherein said rod is pivotally connected at the other end.

29. The collapsible combined table and seat as defined in claim 18, wherein said collapsible brace is a rigid rod pivotally connected at one end to said table and detachably connected at its other end to said main leg.

30. The collapsible combined table and seat as defined in claim 17, wherein said table comprises two like table portions, and means for pivotally connecting said two table portions for movement between an open position in which said two table portions are in end-to-end coplanar relation and a closed position in which said two table portions are in substantially parallel spaced apart confronting relation, and wherein there is a seat for each end of said table, and wherein there is an improved collapsible linkage connecting each one of said seats to the adjacent one of said table portions.

31. The collapsible combined table and seat as defined in claim 30, further comprising a pair of transverse members depending from said table portions along the ends thereof which are in end-to-end relation when said table is in its open position.

32. The collapsible combined table and seat as defined in claim 30, further comprising a collapsible brace for each linkage, each brace being operable to a bracing position, wherein said brace rigidly extends between a pivot on the bottom of said table remote from said one end of said table and a point either on said support member or on said main leg when said support member and main leg are in their respective open positions.

33. The collapsible combined table and seat as defined in claim 32, wherein said seats are elongated benches each having seating locations for at least two persons, and said support members are pivotally connected to their associated bench between two of said seating locations.

34. The collapsible combined table and seat as defined in claim 32, wherein said main leg and said other leg in each linkage are platelike members of length substantially equal to the length of their associated seats, and wherein said means for connecting each of said main legs to its associated other leg comprises a tab extending outwardly in the plane of said other leg from the edge of said other leg which is opposite to said one edge of said other leg, said main leg having a slit therein adjacent the end thereof which is remote from support member when said main leg and support member are in their open positions, said slit being proportioned to receive said tab therein.

* * * * *